United States Patent [19]

Roussel

[11] Patent Number: 4,637,459

[45] Date of Patent: Jan. 20, 1987

[54] ANTI ROTATIONAL DEVICE FOR DOWN HOLE HYDRAULIC PUMPING UNIT

[76] Inventor: Louis J. Roussel, 1500 American Bank Bldg., New Orleans, La. 70130

[21] Appl. No.: 750,536

[22] Filed: Jun. 28, 1985

[51] Int. Cl.[4] ..... E21B 43/12

[52] U.S. Cl. ..... 166/72; 166/77.5; 403/168; 74/21

[58] Field of Search ..... 166/72, 77.5; 74/41, 74/108, 583, 21, 24; 92/116, 129; 403/168

[56] References Cited

U.S. PATENT DOCUMENTS 688,220 12/1901 Zink ..... 74/21

1,649,078 11/1927 Ratigan ..... 74/21

FOREIGN PATENT DOCUMENTS 0312596 5/1929 United Kingdom ..... 74/583

*Primary Examiner*—Stephen J. Novosad
*Assistant Examiner*—Terry Lee Melius
*Attorney, Agent, or Firm*—Bailey & Hardaway

[57] ABSTRACT

An anti rotational device is illustrated for use in a down hole pumping unit operated by a sucker rod driven by a hydraulic pump, fixing the cylinder rod of the hydraulic pump while permitting rotation of the sucker rod driven thereby.

7 Claims, 3 Drawing Figures

ANTI ROTATIONAL DEVICE FOR DOWN HOLE HYDRAULIC PUMPING UNIT

BACKGROUND OF THE INVENTION

This invention relates to a stabilizer or anti rotational apparatus for allowing artificial oil well lift pumping equipment to be operated hydraulically in conjunction with a rod rotator. Formerly rod rotators could be used only on artificial lift systems using a walking beam type lift.

The hydraulic lift system has an advantage over the walking beam type in that it requires less power to operate. The walking-beam type pump, however, allowed the sucker rod to be rotated while in use, giving an even wear to all sides of the rod, and at the same time helping to prevent a paraffin build-up. Apparatus constructed in accordance with the present invention permits the hydraulic pump to accomplish these two functions and at the same time reduces the operating cost.

The chief reason a rotating device can not be directly connected to a hydraulic cylinder is the inability of the cylinder rod head to transmit torque because the rod piston rotates within the cylinder when external torque is placed upon it.

Apparatus constructed in accordance with the invention provides a means for separating the hydraulic ram rod from the sucker rod by means of a spacer means. This spacer member permits the use of a guide and an anti rotational slide means to allow rotation to be imported to the sucker rod without the need of transmitting torque through the hydraulic piston.

The artificial lift system illustrated is of a type used when the pressure of the oil reservoir has fallen to a point where it will no longer produce without some method of artificial lift being applied. While several types of lift pumps are used, the present invention concerns only apparatus wherein a pump at the bottom of the hole is actuated by a string of "sucker rods".

SUMMARY OF THE INVENTION

An important object of this invention is to make possible the use of conventional rod rotators on a down hole hydraulic pumping unit.

It has been found that the hydraulic pump may be connected to the sucker rod through apparatus which fixes the rod of the hydraulic pump against rotation while permitting slight rotation of the sucker rod on each stroke of the pump responsive to a rod rotator which is raised and lowered with said apparatus on each stroke of the pump. This is accomplished by providing a spacer having connecting means on an upper end fixedly fastening the pump rod thereto. On the lower end of the spacer connecting means are provided for carrying a rod rotator driving the sucker rod which is connected for rotation.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate apparatus for connecting a rotated sucker rod used for operating a down hole pump and a hydraulic pump. A pair of vertically spaced bracket member A and B are joined by a vertical spacer C carrying each of said bracket members forming vertical spacer means connecting the pump and the sucker rod. Vertical guide means permit vertical movement of the vertical spacer means but prevent rotation of such means about a vertical axis. Means E fasten the hydraulic pump to an upper member A of the bracket members, and means F fasten the rotated sucker rod to a lower member of the bracket members. The vertical guide means includes an outwardly projecting slide carried by the bracket members and spacer, and spaced vertical rail members defining a vertical guide slot for the slide. The bracket members and said spacer are formed by spaced flanges fixed to at least one vertical web member. A conventional rod rotator G is illustrated as carried by the lower bracket B of the bracket members.

Figure 1:
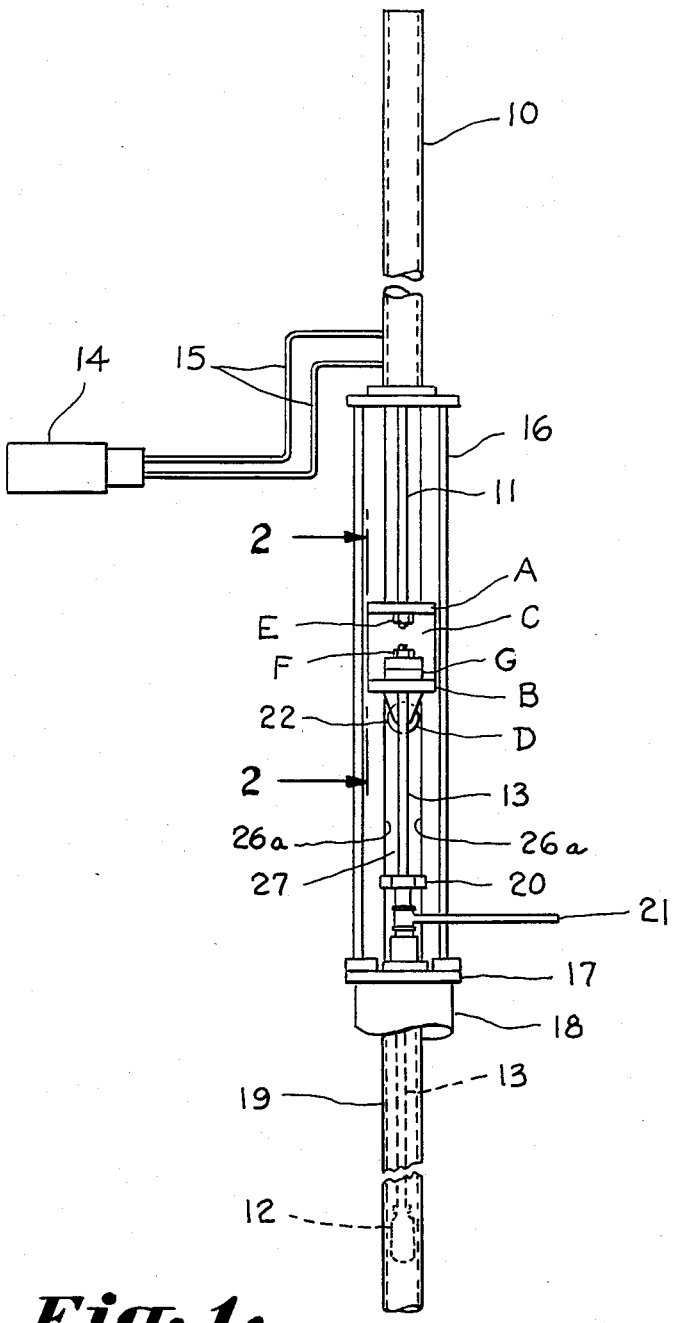
FIG. 1 is a schematic side elevation illustrating a hydraulic pumping unit equipped with an anti rotational device constructed in accordance with the invention.
Figure 2:
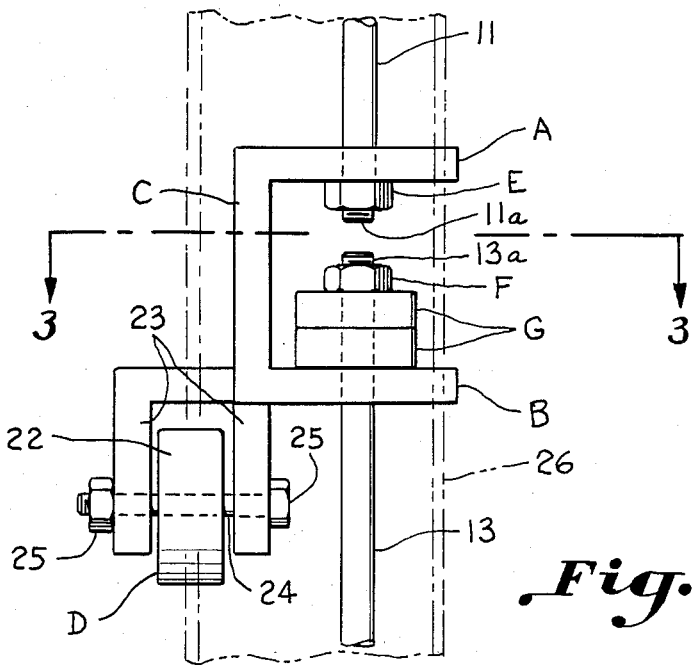
FIG. 2 is a sectional elevation taken on the line 2—2 in FIG. 1, at an enlarged scale, illustrating a vertical spacer serving as a connector between the pump rod and the sucker rod.

FIG. 1 is a schematic illustration of a hydraulic pump having a cylinder 10 and a rod 11 for operating a down hole pump 12 responsive to the stroking of the sucker rod 13. The hydraulic pump has suitable controls 14 for supplying fluid to the cylinder through the lines 15. The pump is carried on the housing 16 which is mounted on the casing head 17. The casing string 18 supports the casing head which surrounds the tubing string 19. A stuffing box is illustrated at 20 and a discharge pipe from a Tee is illustrated at 21.

Figure 3:
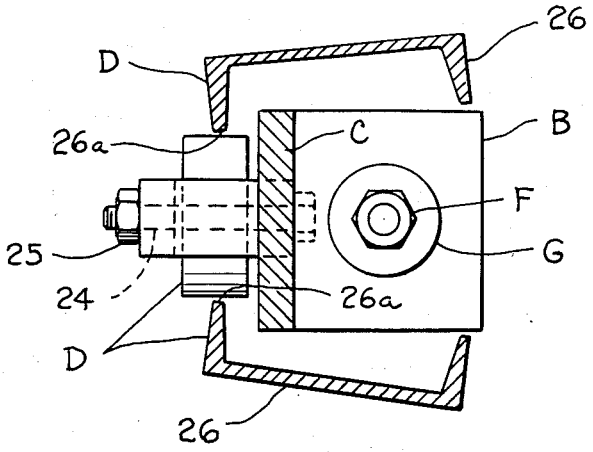
FIG. 3 is a sectional plan view taken on the line 3—3 in FIG. 2.

FIGS. 1 and 3 illustrate the spacer means as including bracket or flange portions A and B integrally carried by a spacer or web portion C. The end of the hydraulic pump rod 11 is threaded as at 11*a* and secured by the fastening means E illustrated in the form of a nut to the upper bracket A in fixed relation. The sucker rod 13 has an upper threaded end 13*a* which carries the fastening means F which includes a nut. The nut positions the usual rod rotator G upon the shaft for providing a slight rotation of the sucker rod on each stroke of the hydraulic pump.

Vertical guide means D include anti friction slide means and a pin or a wheel 22 may be mounted for rotation within the bifurcated member 23 on the shaft 24 secured by bolts 25. The member 23 is suitably secured to the spacer means and extends laterally thereof to serve as part of the guide means.

The vertical structural members 26 have inwardly projecting flanges 26*a* forming rail members for guiding the wheel 22 of the guide means D (FIG. 3). The opposite ends of the structural members 26 extend about the spacer acting as a guide for vertical movement thereof but substantially preventing rotation except within limits afforded within the slot 27 (FIG. 1) defined between the rails 26*a*.

It is then seen that an important advantage of the walking beam type pump has been provided to the hydraulic lift system. Since the hydraulic lift system requires less power, great savings may be achieved. Since the sucker rod may be rotated an even wear may be provided increasing the useful life of the system as well as improved operation by reducing paraffin accumulations.

While a preferred embodiment of the invention has been described using specific terms, such description is for illustrative purposes only, and it is to be understood that changes and variations may be made without departing from the spirit or scope of the following claims.

What is claimed is:

1. Apparatus for connecting a sucker rod used for operating a down hole pump and a hydraulic pump comprising:

a pair of vertically spaced bracket members;

a vertical spacer carrying each of said bracket members;

vertical guide means permitting vertical movement of said bracket members and said vertical spacer but preventing rotation thereof about a vertical axis;

means fastening an extensible portion of said hydraulic pump to an upper of said bracket members;

means fastening said sucker rod to a lower of said bracket members for rotation thereon; and means connected to said sucker rod imparting rotation thereto.

2. The structure set forth in claim 1 wherein said vertical guide means includes an outwardly projecting slide carried by said bracket members and spacer, and spaced vertical rail members defining a vertical guide slot for said slide.

3. The structure set forth in claim 1 wherein said bracket members include vertically spaced flanges and said vertical spacer includes at least one vertical web member intermediate said spaced flanges.

4. The structure set forth in claim 1 wherein said means imparting rotation includes a rod rotater carried by said lower of said bracket members engaging said rod.

5. For use in a down hole pumping unit operated by a sucker rod driven by a hydraulic pump having a cylinder and cylinder rod, an anti rotational device for connecting said cylinder rod to said sucker rod while permitting rotation of the sucker rod comprising:

vertical spacer means connectable adjacent an upper end thereof in fixed relation to said cylinder rod;

means rotating said sucker rod;

means connecting said sucker rod adjacent a lower end of said vertical spacer means for rotation relative thereto; and vertical guide means permitting vertical movement of said vertical spacer means while preventing rotation thereof.

6. The structure set forth in claim 5 wherein said vertical guide means include spaced members defining a vertical guide slot, said spaced members preventing rotation of said spacer means.

7. The structure set forth in claim 5 including means for rotating said sucker rod by a predetermined amount on each stroke of said pump.

* * * * *